US005562155A

United States Patent [19]

Blumberg et al.

[11] Patent Number: 5,562,155

[45] Date of Patent: Oct. 8, 1996

[54] VENTILATED TANK PAGODA

[76] Inventors: Stanley Blumberg, 600 Reisterstown Rd., Baltimore, Md. 21208; Anthony Wells, P.O. Box 219, The Plains, Va. 22171

[21] Appl. No.: 302,293

[22] Filed: Sep. 8, 1994

[51] Int. Cl.[6] ..... F24F 7/00

[52] U.S. Cl. ..... 165/128; 220/565; 454/1; 454/339; 454/370

[58] Field of Search ..... 165/128; 220/367.1, 220/366.1, 360, 565; 454/1, 339, 370, DIG. 900

[56] References Cited

U.S. PATENT DOCUMENTS

| | | | |
|---|---|---|---|
| 1,175,237 | 3/1916 | Cavanaugh et al. . | |
| 1,584,671 | 5/1926 | Sleppy | 165/128 X |
| 2,211,395 | 8/1940 | Waterman . | |
| 2,359,716 | 10/1944 | MacKenzie . | |
| 3,098,702 | 7/1963 | Baker, Jr. et al. . | |
| 3,319,202 | 5/1967 | Lockie | 165/128 X |
| 3,476,032 | 11/1969 | Mattly | 454/136 X |
| 3,815,671 | 6/1974 | Turner | 165/128 X |
| 4,993,314 | 2/1991 | Braden et al. | 454/1 |

FOREIGN PATENT DOCUMENTS

| | | | |
|---|---|---|---|
| 720062 | 2/1932 | France | 454/339 |
| 1942527 | 3/1971 | Germany | 454/339 |
| 1564476 | 5/1990 | U.S.S.R. | 454/339 |

*Primary Examiner*—Harold Joyce
*Attorney, Agent, or Firm*—Donald C. Casey

[57] ABSTRACT

A structure or cooling a large cylindrical storage tank has the shape of an inverted funnel and is intended to be disposed over the tank receiving the upper portion therein and internal struts are provided to separate the funnel wall from the tank wall, The separation allows the entry of air into the funnel structure so that as the structure is heated by the sun air currents will rise through the funnel exiting the chimney which will result in an inflow of air into the funnel around the walls of the tank.

7 Claims, 1 Drawing Sheet

FIG. 1
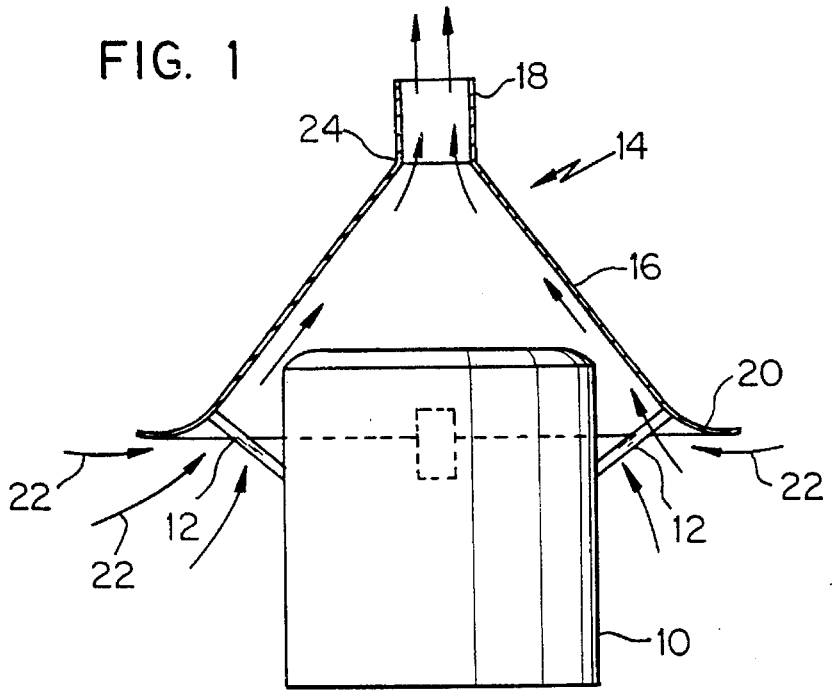
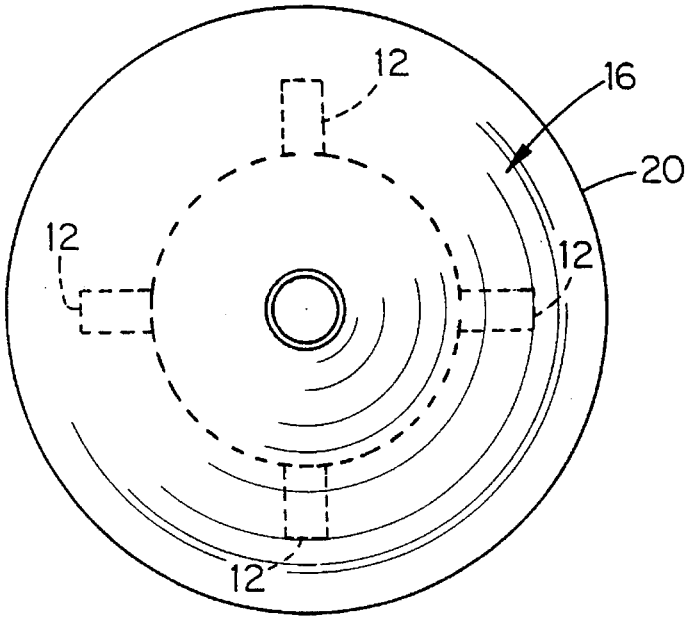
FIG. 2

VENTILATED TANK PAGODA

FIELD OF THE INVENTION

This invention relates to a method for reducing the evaporative loss due to the heat in large fuel tanks and, in particular, to a pagoda type structure mountable over a cylindrical or spherical storage tank which functions to cool the tank and thereby reduce the effects of heat on the tank structure and its contents.

DESCRIPTION OF THE PRIOR ART

For many years, enormous cylindrical or, in some cases, spherical storage tanks have been used to store volatile liquids such as gasoline, aviation fuel, and even crude oil. These tanks typically are several stories high and accordingly, are in and of themselves a very large capital asset without considering the value of their contents. These tanks require continued maintenance in that they are made of metal and must be painted, cleaned and the like, to reduce any chemical interaction between the contents and the tank walls.

When such tanks are used to store volatile liquids such as gasoline, jet fuel and the like, heat effects from atmospheric conditions, can increase maintenance problems. Although the outside surfaces of such tanks are normally painted white or another reflective color, during the day time hours, the sun can heat the contents of the tank, causing increased evaporation of the contents. Unless the tank is vented, the evaporation can cause a pressure build-up within the tank resulting in metal fatigue. In addition, often the corrosive nature of the contents increases at elevated temperatures.

In order to avoid the internal temperature and pressure increase, when the external temperature increases, such tanks are often vented to the atmosphere. This has the undesirable side effect of releasing pollutants such as hydrocarbon vapors. In some structures, attempts are made to capture the vapors vented, condense the same, and return them to the tank. This is, of course, an expensive procedure which requires additional equipment construction, maintenance and the like.

A related problem is presented on a much smaller scale with farm silos. A silo typically is cylindrical in construction and contains fermenting vegetable material. As the material ferments, it generates heat which should be dissipated to avoid spontaneous combustion. In U.S. Pat. No. 1,175.,237, air is circulated through the silo via a central chimney-like vent which extends from the floor thereof to a peaked roof. The air ascending the chimney then is captured against the roof and circulated downwardly around the sides of the structure to be recycled in an upward draft through the chimney.

A similar problem is also presented in grain bins. The grain bins are typically cylindrical in structure and made of metal so that during the day the internal temperature increases dramatically. In, for example, U.S. Pat. Nos. 2,359,716 and 2,211,395 a rooftop ventilator is provided which in effect is a vent outlet at the peak of the roof on the cylindrical structure which allows the venting of heated air which accumulates above the stored grain and typically a fan can be provided to expel such air. This type of device is directed to venting the heated air from within the structure and not to cooling the contents, or the structural walls. This in effect then is a "breathing apparatus". A similar type of breathing apparatus is well known for non-volatile petroleum product storage tanks. See, in general, U.S. Pat. No. 3,098,702 which is related to eliminating the inflow of moisture to a storage tank for non-volatile petroleum products which tanks in effect "breathe". In that situation when external air is warmer than the internal air within the tank, the external air is admitted, and conversely under opposite conditions the internal air is exhausted.

SUMMARY OF THE INVENTION

It has been discovered, however, that large petroleum storage structures can be cooled by providing a rooftop pagoda type structure of the present invention. The cylindrical or spherical tank according to this invention is provided with a funnel shaped structure called herein after a "pagoda" which has at the apex thereof, a chimney opening. The structure of this invention then loosely resembles an inverted funnel which is disposed over the upper portion of the tank and mounted thereon. The chimney in the structure of this invention exhibits a venturi effect whereby as the hot air rises around the tank walls, the air will be drawn into the chimney and expelled upwardly.

The device of this invention then is intended to provide an upwardly moving air current surrounding the external walls of the storage tank whereby the upper portion of the tank is shaded from the sun rays, and internally an upward swirling movement of air is provided to also cool the exterior surface of the tank wall.

The structure of this invention then has no moving parts and is in effect a large conical pagoda, triangular in cross-section, with a chimney provided at the apex thereof. As the sun's energy heats the pagoda walls, the air within will be heated and will rise through the chimney. This rising air current then creates a low pressure situation whereby external air enters the structure from below and continues to pass upwardly. The upwardly movement of air past the walls of the tank then and between the tank and internal pagoda walls, results in the cooling effect generated by the device of this invention.

Accordingly, it is an object of this invention to provide a pagoda-like structure for fuel storage tanks which will facilitate the movement of an upwardly flow of air along the outer surfaces of the tank walls without the use of a fan or other mechanical device.

It is another object of this invention to provide a cooling roof-like structure which is substantially conical and has a chimney at the apex thereof so that a cooling effect will be provided by the chimney which will draw outside air into the conical structure for movement upwardly along the walls of the storage tank.

It is a further object of this invention to provide a method for cooling the external surfaces of cylindrical or spherical storage tanks by providing an inverted conical pagoda disposed over the upper portion thereof and which has an axial chimney extending upwardly so that air will be drawn into the structure around the walls of the tank which air will then move upwardly through the chimney to create a constant moving flow of cooling air across the outer tank surface.

BRIEF DESCRIPTION OF THE DRAWINGS

These and other objects will become clearly apparent with reference to the drawings and following description wherein:

FIG. 1 is a front view of the device of this invention mounted on a cylindrical tank.

FIG. 2 is a top view of the structure of FIG. 1.

DETAILED DESCRIPTION OF THE INVENTION

This invention is primarily applicable to storage tanks which contain volatile liquids such as gasoline, aviation fuel and the like. However, this invention is not intended to be limited to the material contained within the storage tanks as will be obvious to those skilled in the art. Whether the material contained within a sewage tank is liquid or gaseous, volatile, or essentially non-volatile, is not important. In each case, the condition of the storage tank from the standpoint of structural integrity and from the standpoint of maintenance required, will be improved by cooling the external surface of the walls using the device of this invention.

In addition, the device of this invention is primarily intended for use with cylindrical storage tanks. Possibly, such tanks could be spherical, or possibly even rectangular. The shape of the storage tank, however, is not important to the functioning of the device of this invention. Hereinafter, the invention will be described in terms of use with a cylindrical storage tank but it will be understood that such a tank could be any conceivable shape.

With attention to the drawings, the device of this invention is intended to be mounted on a storage tank typically by use of a plurality of mutually spaced struts 12. The device of this invention is an inverted funnel 14 in shape which consists typically of a frustroconical hollow body 16 which terminates in an upstanding chimney 18 at its apex. In a further embodiment of this invention, the downward or lower portion thereof terminates in a flange 20 which is intended to assist in directing air currents 22 as shown in FIG. 1 upwardly into the interior of the conical portion 16 of funnel 14.

As will be observed from the drawings and from FIG. 1 in particular, when the interior of conical portion 16 becomes heated as by the sun, the air within will expand and move upwardly as it expands. The air then will pass through throat 24 where the venturi effect is exhibited. In effect, as the air is compressed entering the chimney 18, the velocity will be increased, the pressure will drop, and additional air from the interior of 16 of the funnel 14 will be drawn into the throat 24. The continued low pressure at the throat 24 also will, in effect, draw air in under the flange 20 in the form of currents shown in FIG. 1. As this air enters, it will pass along the upper surface of the storage tank 10 and in effect act as a cooling medium drawing heat from the skin of said tank.

Typically storage tanks 10 are constructed of metal and are left exposed to the sun. Even though the tank may be painted white or some other reflective material, the interior thereof will be dramatically affected by intense sun rays during the daytime hours.

As a result of direct sun light upon the upper surface of tank 10 without the device of this invention 14, the pressure and temperature of the liquid within the tank will be increased. If the liquid is volatile, evaporation will occur further increasing the pressure within the tank. If the liquid is essentially non-volatile, it will increase in temperature, and whatever air or vapor is disposed above liquid surface will increase in pressure. If the tank is full, then the primary effect will be heating the essentially non-volatile liquid by conduction from the walls of the tank.

As is well known to those skilled in the art, when the internal pressure of the vapor within the tank increases, the metal walls thereof will be stressed. In addition, if the liquid and vapors stored are corrosive, their corrosive nature will be increased by an increase in temperature. Corrosion in large petroleum storage tanks, for example, is minimized by painting the interior of the tank. If the time between repainting the interior of the tank can be extended, obviously a great cost savings can be realized. Such an extension would occur if the tank contents are maintained over a period of time at a temperature less than that which would be exhibited by the tank when exposed to direct sunlight over its upper portion.

The device of this invention then has no moving parts, but is intended to facilitate the rapid movement of air at least across the outer surface of the tank walls, and in effect, to also shade the outer surface of the tank from direct sunlight. Typically, the device would be mounted to cover at least the upper one-fourth of the tank and preferably to shade most of the tank through the extension of flange 20 through most of the day. The device of this invention, of course, must have walls at a sufficient angle so that an adequate air space is provided between the top-most portion of the storage tank and the internal surface of the funnel 16.

In summary, the device of this invention is intended to be mounted on storage tanks and is essentially an inverted funnel which has a frustro-conical section intended to cover the upper portion of the tank and extend upwardly from the walls thereof to shade the tank. Most importantly, however, the apex of the frustro-conical funnel portion mounts an integral upstanding chimney. The entrance to the chimney forms a venturi throat whereby as air is heated within the funnel, it will be expelled upperwardly through the venturi throat chimney resulting in a decrease in pressure which will in turn draw in additional air from below whereby the outer surface at least of the storage tanks will be cooled in a moving stream as well as being shaded by the structure of this invention.

The result then will be a decrease in the internal temperature of the contents of the tank over that which would be achieved if the structure of this invention were not used and the tank was exposed to direct sunlight. This decreased temperature then will result in less evaporative loss, lower internal pressure, and less heating of the contents of the tank to thereby extend the useful life of the storage tank and reduce maintenance thereof.

It will be readily seen by one of ordinary skill in the art that the present invention fulfills all of the objects set forth above. After reading the foregoing specification, one of ordinary skill will be able to effect various changes,substitutions or equivalents and various other aspects of the invention as broadly disclosed herein. It is therefore intended that the protection granted hereon be limited only by the definition contained in the appended claims and equivalents thereof.

We claim:

1. A cooling device for a storage tank comprising an inverted funnel shaped structure having walls forming a hollow frustroconical portion and an axial chimney extending upwardly from the apex thereof, said funnel shaped structure adapted to be mounted over a storage tank and to receive the upper portion of a tank therein, said funnel shaped structure having an open base of sufficient diameter to receive said upper portion, and spacing means spacing the walls of said structure from the tank when an upper portion is received therein so that air can pass therebetween upwardly through said chimney.

2. The structure of claim 1 wherein said funnel shaped structure includes an outwardly extending flange at the base thereof to facilitate the entrance of air thereinto.

3. The structure of claim 1 wherein said spacing means comprises a plurality of mutually spaced struts.

4. A method for cooling a large cylindrical storage tank comprising:

providing an inverted funnel shaped pagoda for said tank said pagoda having a frustroconical shape with an axial chimney extending upwardly therefrom;

mounting said inverted funnel pagoda over said tank, receiving the upper portion of said tank therein, but providing an air space between said pagoda walls and said tank around the periphery thereof whereby as said pagoda is heated air within will ascend the chimney providing an upwardly directed air current through said air space.

5. The method of claim 4 wherein said pagoda further includes an outwardly extending flange surrounding the periphery thereof.

6. The method of claim 4 wherein said pagoda has an opening for receiving the upper portion of said tank and mutually spaced struts are disposed therearound to provide the air space therebetween.

7. The method of claim 6 wherein a peripheral flange is provided surrounding the opening receiving said tank.

* * * * *